US012085073B2

(12) United States Patent
Deng et al.

(10) Patent No.: US 12,085,073 B2
(45) Date of Patent: Sep. 10, 2024

(54) VALVE SPRING FIXING DEVICE AND PLUNGER PUMP

(71) Applicant: Yantai Jereh Petroleum Equipment & Technologies Co., Ltd., Shandong (CN)

(72) Inventors: Wenjie Deng, Yantai (CN); Baoguo Jian, Yantai (CN); Weichen Liu, Yantai (CN); Peng Li, Yantai (CN); Jixin Wang, Yantai (CN); Xiaosong Wei, Yantai (CN); Chen Jiang, Yantai (CN); Xiaobin Li, Yantai (CN); Wenping Cui, Yantai (CN); Anpeng Ge, Yantai (CN)

(73) Assignee: YANTAI JEREH PETROLEUM EQUIPMENT & TECHNOLOGIES CO., LTD., Yantai (CN)

( * ) Notice: Subject to any disclaimer, the term of this patent is extended or adjusted under 35 U.S.C. 154(b) by 93 days.

(21) Appl. No.: 17/954,436

(22) Filed: Sep. 28, 2022

(65) Prior Publication Data

US 2023/0017968 A1 Jan. 19, 2023

Related U.S. Application Data

(63) Continuation-in-part of application No. 17/375,233, filed on Jul. 14, 2021, now Pat. No. 11,519,405.

(30) Foreign Application Priority Data

Apr. 21, 2021 (CN) ..... 202110430556.4
Sep. 28, 2021 (CN) ..... 202122363943.9

(51) Int. Cl.
*F16K 17/04* (2006.01)
*E21B 43/12* (2006.01)
*F04B 53/10* (2006.01)

(52) U.S. Cl.
CPC ..... *F04B 53/10* (2013.01); *E21B 43/121* (2013.01)

(58) Field of Classification Search
CPC ..... F04B 53/10; E21B 43/121
See application file for complete search history.

(56) References Cited

U.S. PATENT DOCUMENTS 1,316,539 A * 9/1919 Ford ..... F16K 1/42 251/363
1,873,318 A * 8/1932 Eason, Jr. ..... F04B 53/1027 137/540

(Continued)

FOREIGN PATENT DOCUMENTS

CN 203114605 U 8/2013
CN 204239229 U 4/2015

(Continued)

OTHER PUBLICATIONS

International Search Report and Written Opinion mailed on Oct. 17, 2022, in corresponding PCT/CN2022/116723, 12 pages.

*Primary Examiner* — P. Macade Nichols
(74) *Attorney, Agent, or Firm* — XSENSUS LLP

(57) ABSTRACT

A valve spring fixing device and a plunger pump are disclosed. The valve spring fixing device includes a spring fixing piece, which includes a first supporting surface and a second supporting surface located at two ends of the spring fixing piece, and an intermediate portion located between the first supporting surface and the second supporting surface; and a spring mounting portion connected with the intermediate portion and configured to mount a valve spring, the first supporting surface and the second supporting surface are configured to contact with a valve box to fix the valve spring fixing device.

20 Claims, 8 Drawing Sheets

900/0300

(56) References Cited

U.S. PATENT DOCUMENTS

| | | | |
|---|---|---|---|
| 7,681,589 | B2 | 3/2010 | Schwegman |
| 2014/0083541 | A1 | 3/2014 | Chandrasekaran et al. |
| 2014/0086774 | A1 | 3/2014 | Chandrasekaran et al. |
| 2019/0072089 | A1* | 3/2019 | Buckley ..... F04B 1/0461 |

FOREIGN PATENT DOCUMENTS

| | | | |
|---|---|---|---|
| CN | 104500359 | B | 1/2017 |
| CN | 205990989 | U | 3/2017 |
| CN | 207554322 | U | 6/2018 |
| CN | 207879585 | U | 9/2018 |
| CN | 210509136 | U | 5/2020 |
| CN | 111502981 | A | 8/2020 |
| CN | 111692065 | A | 9/2020 |
| CN | 211517318 | U | 9/2020 |
| CN | 112922827 | A | 6/2021 |
| CN | 216111233 | U | 3/2022 |

* cited by examiner

400

900/0300

900/0300

0200

VALVE SPRING FIXING DEVICE AND PLUNGER PUMP

CROSS-REFERENCE TO RELATED APPLICATIONS

This application is a continuation in part of U.S. Ser. No. 17/375,233 filed on Jul. 14, 2021, which claims the priority of Chinese patent application No. 202110430556.4 filed on Apr. 21, 2021, and claims the priority of Chinese patent application No. 202122363943.9 filed on Sep. 28, 2021. For all purposes, the disclosure of which is incorporated herein by reference in its entirety as part of the present application.

TECHNICAL FIELD

Embodiments of the present disclosure relate to a valve spring fixing device and a plunger pump.

BACKGROUND

In the field of oil and gas exploitation, fracturing technology is a method to make oil and gas reservoirs crack by using high-pressure fracturing fluid. Fracturing technology can improve the flowing environment of oil and gas underground by causing cracks in oil and gas reservoirs, which can increase the output of oil wells, therefore, it is widely used in conventional and unconventional oil and gas exploitation, offshore and onshore oil and gas resources development.

Plunger pump is a device that uses the reciprocating motion of a plunger in a cylinder to pressurize liquid. Plunger pump has the advantages of high rated pressure, compact structure and high efficiency, so it is used in fracturing technology.

SUMMARY

At least one embodiment of the present disclosure provides a valve spring fixing device, which includes: a spring fixing piece, including a first supporting surface and a second supporting surface located at two ends of the spring fixing piece, and an intermediate portion located between the first supporting surface and the second supporting surface; and a spring mounting portion connected with the intermediate portion and configured to mount a valve spring, the first supporting surface and the second supporting surface are configured to contact with a valve box to fix the valve spring fixing device.

For example, in the valve spring fixing device provided by an embodiment of the present disclosure, the spring fixing piece includes: a body portion, including a first end portion, a second end portion, and the intermediate portion located between the first end portion and the second end portion; a first supporting portion connected with the first end portion and located at a first side of the body portion; and a second supporting portion connected with the second end portion and located at the first side of the body portion; the spring mounting portion is located at a second side of the body portion, and the second side and the first side are two sides facing away from each other; the first supporting portion includes the first supporting surface located at an end of the first supporting portion away from the first end portion, the second supporting portion includes the second supporting surface located at an end of the second supporting portion away from the second end; the spring fixing piece further includes a limiting groove, which is configured to place a limiting assembly; the limiting groove is located in at least one of the first supporting portion and the second supporting portion, and is exposed to at least one of the first supporting surface and the second supporting surface.

For example, in the valve spring fixing device provided by an embodiment of the present disclosure, the limiting groove is further located in the body portion.

For example, in the valve spring fixing device provided by an embodiment of the present disclosure, the first supporting portion extends in a first direction and the second supporting portion extends in a second direction; an included angle between the first direction and a direction perpendicular to a first surface of the body portion at the first side ranges from 120 to 150 degrees, and an included angle between the second direction and the direction perpendicular to the first surface of the body portion at the first side ranges from 120 to 150 degrees.

For example, in the valve spring fixing device provided by an embodiment of the present disclosure, the limiting groove includes a first end and a second end, the first end is located at the first supporting surface, the second end is located at the second end portion, and the limiting groove extends from the first supporting surface to the second end portion.

For example, in the valve spring fixing device provided by an embodiment of the present disclosure, the limiting groove is exposed to the first surface of the body portion at the first side and a surface of the first supporting portion connected with the first surface.

For example, in the valve spring fixing device provided by an embodiment of the present disclosure, the second end penetrates through the body portion and is exposed to a second surface of the body portion at the second side.

For example, in the valve spring fixing device provided by an embodiment of the present disclosure, the limiting groove includes a first end and a second end, the first end is located at the first supporting surface, the second end is located at the second supporting surface, and the limiting groove extends from the first supporting surface to the second supporting surface.

For example, in the valve spring fixing device provided by an embodiment of the present disclosure, the limiting groove is exposed to a first surface of the body portion at the first side, a surface of the first supporting portion connected to the first surface and a surface of the second supporting portion connected to the first surface.

For example, the valve spring fixing device provided by an embodiment of the present disclosure further includes: a limiting assembly, located in the limiting groove, the limiting assembly includes a limiting portion, and the limiting portion protrudes from the first supporting surface and/or the second supporting surface.

For example, in the valve spring fixing device provided by an embodiment of the present disclosure, the limiting assembly includes a snap spring.

For example, the valve spring fixing device provided by an embodiment of the present disclosure further includes: a pin hole located in the first supporting portion and/or the second supporting portion and passing through the limiting groove; and a limiting pin configured to be inserted into the pin hole to fix the limiting assembly in the limiting groove.

At least one embodiment of the present disclosure further provides a plunger pump, which includes: a valve box, including a valve box body, a first chamber, a supporting groove and a valve box groove, wherein the first chamber is located in the valve box body and extends along a third direction; the supporting groove is located in an inner sidewall of the first chamber and extends along a circumferential direction of the first chamber; the supporting groove includes an inclined sidewall, and the valve box groove intersects with the inclined sidewall and extends along the third direction; and a valve spring fixing device, including a spring fixing piece and a spring mounting portion, wherein the spring fixing piece includes a first supporting surface and a second supporting surface located at two ends of the spring fixing piece and an intermediate portion located between the first supporting surface and the second supporting surface; the spring mounting portion is connected with the intermediate portion and configured to mount a valve spring, the first supporting surface and the second supporting surface are contacted with the supporting groove to fix the valve spring fixing device in the valve box.

For example, in the plunger pump provided by an embodiment of the present disclosure, the spring fixing piece includes; a body portion, including a first end portion, a second end portion, and the intermediate portion located between the first end portion and the second end portion; a first supporting portion, connected with the first end portion and located at a first side of the body portion; and a second supporting portion, connected with the second end portion and located at the first side of the body portion; the spring mounting portion is located at a second side of the body portion, and the second side and the first side are two sides facing away from each other; the first supporting portion includes the first supporting surface located at an end of the first supporting portion away from the first end portion; the second supporting portion includes the second supporting surface located at an end of the second supporting portion away from the second end portion; the spring fixing piece further includes a limiting groove, which is configured to place a limiting assembly; the limiting groove is located in at least one of the first supporting portion and the second supporting portion and exposed to at least one of the first supporting surface and the second supporting surface.

For example, in the plunger pump provided by an embodiment of the present disclosure, the limiting groove is further located at the body portion.

For example, in the plunger pump provided by an embodiment of the present disclosure, the first supporting portion extends in a first direction, and the second supporting portion extends in a second direction; an included angle between the first direction and a direction perpendicular to a first surface of the body portion at the first side ranges from 120 to 150 degrees, and an included angle between the second direction and a direction perpendicular to the first surface of the body portion at the first side ranges from 120 to 150 degrees.

For example, in the plunger pump provided by an embodiment of the present disclosure, the limiting groove includes a first end and a second end, the first end is located at the first supporting surface, the second end is located at the second end portion, and the limiting groove extends from the first supporting surface to the second end portion.

For example, in the plunger pump provided by an embodiment of the present disclosure, the valve box further includes: a second chamber, located in the valve box body and extending along a fourth direction, the second chamber and the first chamber intersect to form an intersection area, and the supporting groove and the valve box groove are located in the intersection area.

For example, the plunger pump provided by an embodiment of the present disclosure further includes: a plunger, located in the second chamber and configured to reciprocate along the second chamber; a cover, located at an side of the valve spring fixing device; and a nut, located at an side of the cover away from the valve spring fixing device.

For example, the plunger pump provided by an embodiment of the present disclosure further includes: a power end, connected with the plunger and configured to drive the plunger to reciprocate.

BRIEF DESCRIPTION OF THE DRAWINGS

In order to more clearly illustrate the technical solutions of the embodiments of the disclosure, the drawings of the embodiments will be briefly described in the following; it is obvious that the described drawings below are only related to some embodiments of the disclosure and thus are not limitative to the disclosure.

DETAILED DESCRIPTION

In order to make objectives, technical details and advantages of the embodiments of the present disclosure more clearly, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment (s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms "include," "including," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly.

In the plunger pump, the valve assembly is an important assembly. The valve assembly usually includes a valve spring seat, a spring, a valve body and a valve seat. The valve spring seat is arranged in a chamber, the spring is arranged on the valve spring seat, one end of the valve body is in contact with the spring, and the other end of the valve body is in contact with the valve seat. Under the elastic force of the spring, the valve body can seal an intermediate hole of the valve seat, so as to achieving closing the valve assembly; upon the force exerted by the fluid on the valve body in the direction from the valve seat to the valve spring seat being greater than the elastic force of the spring, the valve body is separated from the valve seat or partially separated, so that the intermediate hole of the valve seat cannot be sealed, thus achieving opening the valve assembly. On the other hand, upon the fluid exerting a force on the valve body from the valve spring seat to the valve seat, the valve body still seals the intermediate hole of the valve seat. Therefore, the valve assembly is also a one-way valve.

Figure 1:
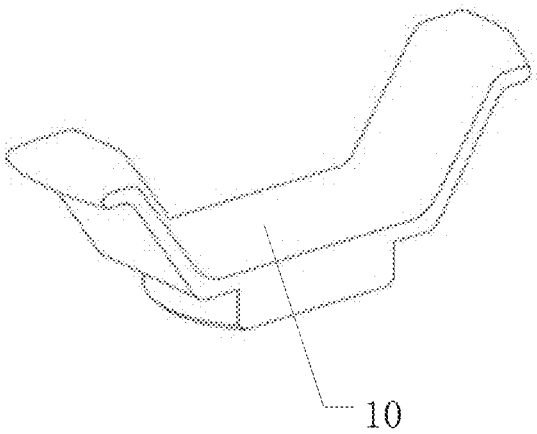
FIG. 1 is a schematic diagram of a valve spring seat.
Figure 2:
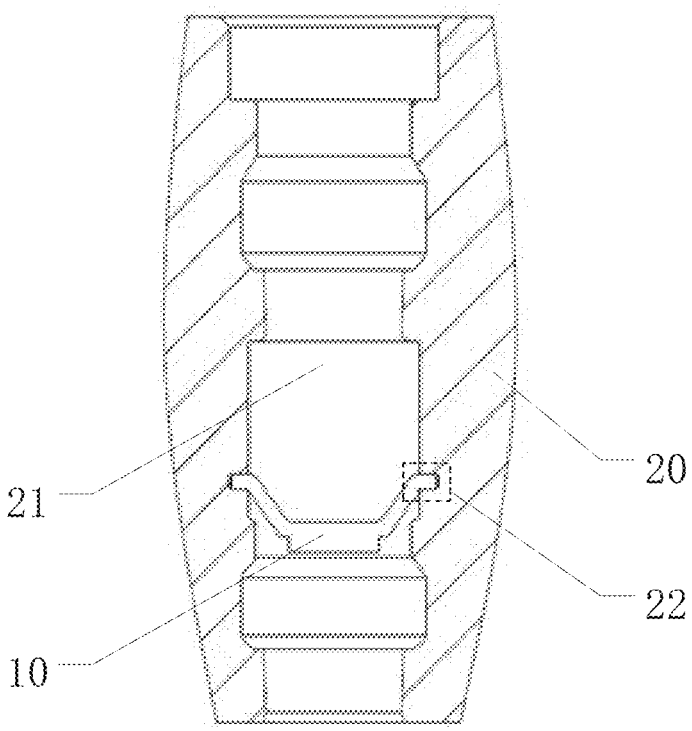
FIG. 2 is a schematic assembly diagram of a valve spring seat.

FIG. 1 is a schematic diagram of a valve spring seat; FIG. 2 is a schematic assembly diagram of a valve spring seat. As illustrated in FIG. 1 and FIG. 2, in the mounting process of the valve spring seat 10, it is needed to accurately align the valve spring seat 10 with the spring, resulting in inconvenient installation. Secondly, it is needed to set an annular groove 22 in the chamber 21 inside the valve box 20 to fix the position of the valve spring seat 10, and the position where the annular groove 22 is located is easy to produce large stress concentration, which easily leads to the rupture of the valve box 20 and reduces the service life of the valve box 20. In addition, during the use process of the valve spring seat 10, the valve spring seat 10 is easy to rotate in the annular groove 22, resulting in poor spring fixing effect.

Therefore, the embodiments of the present disclosure provide a valve spring seat sleeve, a valve assembly and a plunger pump. The valve spring seat sleeve includes a cylindrical hollow structure, a first fluid hole, a first notch and a second notch. The cylindrical hollow structure includes a plunger passage located in the cylindrical hollow structure. The first fluid hole passes through a sidewall of the cylindrical hollow structure and is communicated with the plunger passage. The first notch is located at a side of the cylindrical hollow structure opposite to the first fluid hole. The second notch is located at the side of the cylindrical hollow structure opposite to the first fluid hole. The cylindrical hollow structure includes a first end portion, a second end portion and an intermediate portion between the first end portion and second end portion. Therefore, on the one hand, the installation and disassembly process of the valve spring seat sleeve is convenient, and there is no need to arrange a groove in the chamber, so that the stress concentration can be reduced and the service life of the valve box can be prolonged; on the other hand, the valve spring seat sleeve can provide a more stable fixing effect for the spring, and can also avoid rotation in the chamber, thereby improving the performance of the valve assembly.

Hereinafter, the valve spring seat sleeve, the valve assembly and the plunger pump provided by the embodiments of the present disclosure will be described in detail with reference to the accompanying drawings.

Figure 3:
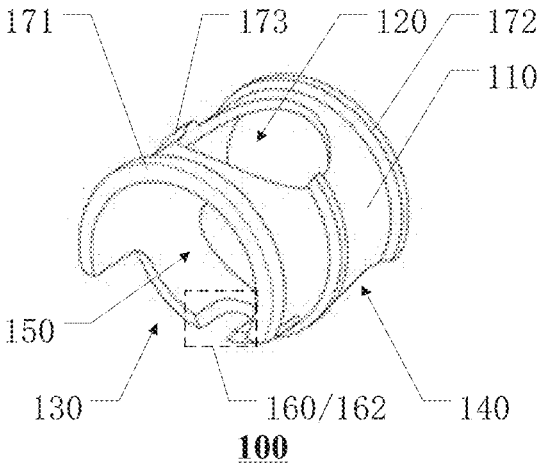
FIG. 3 is a structural schematic diagram of a valve spring seat sleeve according to an embodiment of the present disclosure.
Figure 4:
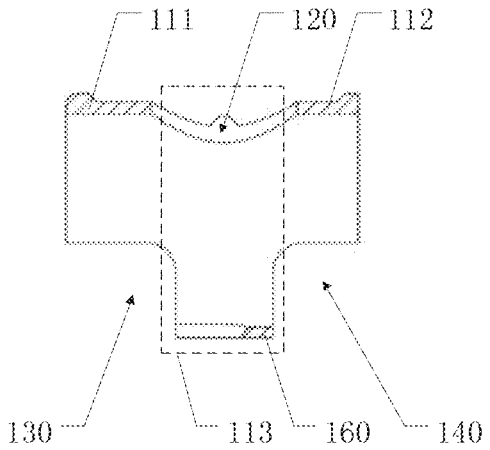
FIG. 4 is a sectional view of a valve spring seat sleeve according to an embodiment of the present disclosure.
Figure 5:
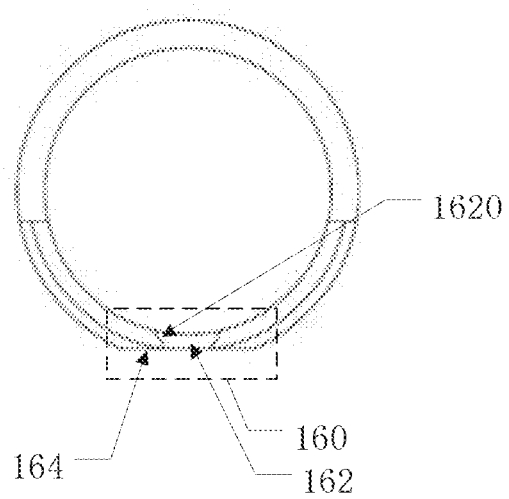
FIG. 5 is a side view of a valve spring seat sleeve according to an embodiment of the present disclosure.

An embodiment of the present disclosure provides a valve spring seat sleeve. FIG. 3 is a structural schematic diagram of a valve spring seat sleeve according to an embodiment of the present disclosure; FIG. 4 is a sectional view of a valve spring seat sleeve according to an embodiment of the present disclosure; FIG. 5 is a side view of a valve spring seat sleeve according to an embodiment of the present disclosure.

As illustrated in FIGS. 3 and 4, the valve spring seat sleeve 100 includes a cylindrical hollow structure 110, a first fluid hole 120, a first notch 130 and a second notch 140. The cylindrical hollow structure 110 includes a plunger passage 150 located in the cylindrical hollow structure 110, and the plunger passage 150 is configured to allow a plunger to pass through, so its radial size should be greater than or equal to a radial size of the plunger. The first fluid hole 120 passes through the sidewall of the cylindrical hollow structure 110 and is communicated with the plunger passage 150. The first notch 130 is located at a side of the cylindrical hollow structure 110 opposite to the first fluid hole 120. The second notch 140 is located at the side of the cylindrical hollow structure 110 opposite to the first fluid hole 120. Therefore, fluid can enter the plunger passage 150 from the first notch 130 and the second notch 140 and flow out from the first fluid hole 120. It should be noted that the above-mentioned "first notch" and "second notch" refer to the missing or removed part of the cylindrical hollow structure.

As illustrated in FIGS. 3 and 4, the cylindrical hollow structure 110 includes a first end portion 111, a second end portion 112 and an intermediate portion 113 between the first end portion 111 and the second end portion 112. The first end portion 111, the intermediate portion 113 and the second end portion 112 are arranged in sequence in the extending direction of the cylindrical hollow structure 110. The center of the first fluid hole 120 is located at the intermediate portion 113, the first notch 130 is located at the first end portion 111, the second notch 140 is located at the second end portion 112, and the cylindrical hollow structure 110 further includes a spring mounting portion 160 located between the first notch 130 and the second notch 140.

In the valve spring seat sleeve provided by the embodiment of the present disclosure, the spring mounting portion can be used for mounting and fixing the spring, and fluid can enter the plunger passage from the first notch and the second notch on two sides of the spring mounting portion and flow out from the first fluid hole. The cylindrical hollow structure does not need to be fixed by arranging a groove in the inner chamber of the valve box, thus reducing stress concentration and prolonging the service life of the valve box. On the other hand, the valve spring seat sleeve will not rotate in the chamber inside the valve box, so it can provide a more stable fixing effect for the spring, thus improving the performance of the valve assembly.

In some examples, as illustrated in FIGS. 3 and 4, the first notch 130 is located at the first end portion 111 and recessed from an edge of the first end portion 111 to the intermediate portion 113, and the second notch 140 is located at the second end portion 112 and recessed from an edge of the second end portion 112 to the intermediate portion 113. Therefore, on the one hand, the first notch 130 and the second notch 140 are convenient for manufacturing; on the other hand, the first notch 130 and the second notch 140 have larger areas, so that the flow rate of fluid passing through the valve spring seat sleeve can be increased.

Of course, the embodiments of the present disclosure include but are not limited thereto. The first notch can also be located at a side of the edge of the first end portion close to the intermediate portion, that is, the first notch is surrounded by the edge of the first end portion and the intermediate portion, and in this case, the first notch can have a closed shape. Similarly, the second notch can also be located at a side of the edge of the second end portion close to the intermediate portion, that is, the second notch is surrounded by the edge of the second end portion and the intermediate portion, and in this case, the second notch can have a closed shape.

In some examples, as illustrated in FIGS. 3 and 4, the first fluid hole 120 is arranged opposite to the spring mounting portion 160. Therefore, both the first fluid hole and the spring mounting portion are roughly located in the intermediate portion, so that the stress condition of the valve spring seat sleeve can be optimized, and the strength of the valve spring seat sleeve can be improved.

In some examples, as illustrated in FIGS. 3 and 4, the valve spring seat sleeve further includes: a first boss 171, arranged on an outer surface of the cylindrical hollow structure 110 and along an edge of the first end portion 111; a second boss 172, arranged on an outer surface of the cylindrical hollow structure 110 and along an edge of the second end portion 112; and a third boss 173, arranged on an outer surface of the cylindrical hollow structure 110 and located between the first boss 171 and the second boss 172, and disconnected at the position where the first fluid hole 120 is located. Therefore, the first boss 171, the second boss 172 and the third boss 173 can increase the structural strength of the cylindrical hollow structure 110 without affecting the passage of the plunger.

In some examples, as illustrated in FIGS. 3 and 4, the spring mounting portion 160 includes a U-shaped groove 162, the U-shaped groove 162 is recessed from the bottom of the first notch 130 to the second notch 140, and the U-shaped groove 162 is configured to mount the spring seat. Therefore, the U-shaped groove 162 can mount the spring seat in a clamping manner without precise alignment, thereby reducing the difficulty of mounting and dismounting. For example, the spring seat can be slid into the U-shaped groove from the open end of the U-shaped groove to fix the U-shaped groove with the spring seat. For example, the bottom of the notch refers to a part close to the intermediate portion of the cylindrical hollow structure.

In some examples, as illustrated in FIG. 5, a surface of the spring mounting portion 160 away from the plunger passage 150 includes a mounting surface 164, and a cut surface of the spring mounting portion 160 cut by the U-shaped groove 162 is an inclined surface 1620, and the included angle between the inclined surface 1620 and the mounting surface 164 is less than 90 degrees, so that upon the spring seat includes an inclined surface or a conical surface, the spring seat can be fixed in the U-shaped groove.

In some examples, as illustrated in FIG. 5, the included angle between the inclined surface 1620 and the mounting surface 164 is less than 80 degrees.

Figure 6:
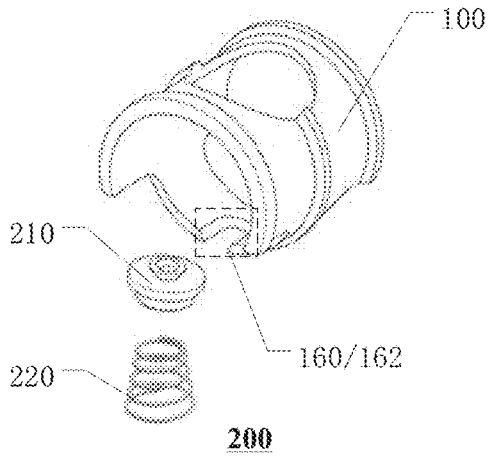
FIG. 6 is a schematic diagram of a valve assembly according to an embodiment of the present disclosure.
Figure 7:
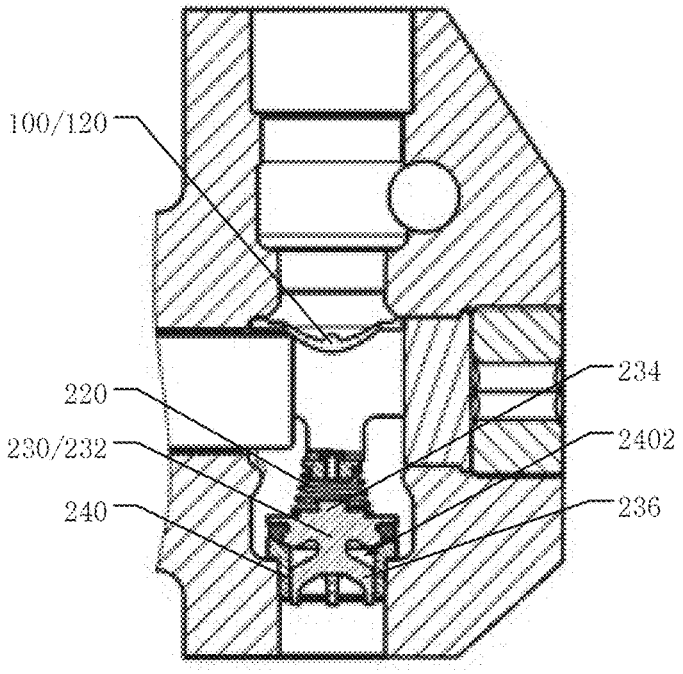
FIG. 7 is a partial schematic diagram of a valve assembly mounted on a hydraulic end according to an embodiment of the present disclosure.

An embodiment of the present disclosure further provides a valve assembly. FIG. 6 is a schematic diagram of a valve assembly provided by an embodiment of the present disclosure; FIG. 7 is a partial schematic diagram of a valve assembly mounted on a hydraulic end according to an embodiment of the present disclosure. As illustrated in FIGS. 6 and 7, the valve assembly 200 includes the valve spring seat sleeve 100, the spring seat 210 and the spring 216 provided by any of the above examples. The spring seat 210 is mounted on the spring mounting portion 160. The spring 220 is mounted on the spring seat 210.

In the valve assembly provided by the embodiment of the present disclosure, the spring seat can fix the spring on the spring mounting portion, and fluid can enter the plunger passage from the first notch and the second notch on two sides of the spring mounting portion and flow out from the first fluid hole. The cylindrical hollow structure does not need to be fixed by arranging a groove in the inner chamber of the valve box, thus reducing stress concentration and prolonging the service life of the valve box. On the other hand, the valve spring seat sleeve will not rotate in the chamber inside the valve box, so it can provide a more stable fixing effect for the spring, thus improving the performance of the valve assembly.

In some examples, as illustrated in FIG. 7, the valve assembly 200 further includes a valve body 230 and a valve seat 240. The valve body 230 includes a valve main body portion 232, and a spring connecting portion 234 and a guiding portion 236 respectively arranged at two sides of the valve main body portion 232. The valve seat 240 is located at a side of the valve body 230 away from the valve spring seat sleeve 100 and includes an intermediate hole 2402. The spring connecting portion 234 is connected with the spring 220, the guiding portion 236 is located in the intermediate hole 2402, and the valve main body portion 232 is configured to move close to or away from the valve seat 240 to open or close the intermediate hole 2402, thereby achieving the opening or closing of the valve assembly 200.

In some examples, as illustrated in FIG. 7, under the elastic force of the spring 220, the valve body 230 can seal the intermediate hole 2402 of the valve seat 240 to close the valve assembly 200. Upon the force exerted by the fluid on the valve body 230 in the direction from the valve seat 240 to the valve spring seat sleeve 100 being greater than the elastic force of the spring 220, the valve body 230 is separated or partially separated from the valve seat 240, so that the intermediate hole 2402 of the valve seat 240 cannot be sealed, thereby realizing the opening of the valve assembly 200. On the other hand, upon the fluid exerting a force on the valve body 230 in the direction from the valve spring seat sleeve 100 to the valve seat 240, the valve body 230 still seals the intermediate hole 2402 of the valve seat 240. Therefore, the valve assembly 200 can achieve a one-way valve.

Figure 8:
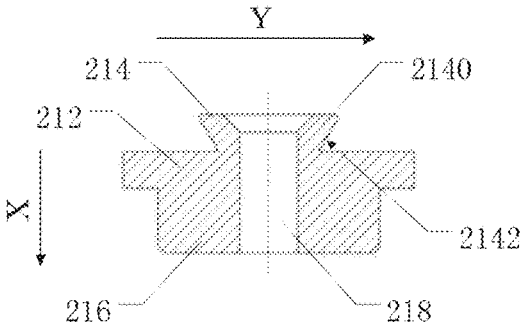
FIG. 8 is a schematic sectional view of a spring seat according to an embodiment of the present disclosure.

FIG. 8 is a schematic sectional view of a spring seat according to an embodiment of the present disclosure. As illustrated in FIGS. 6 and 8, the spring mounting portion 160 includes a U-shaped groove 162, the U-shaped groove 162 is recessed from the bottom of the first notch 130 to the second notch 140. The spring seat 210 includes: a spring beat body 212; a first mounting portion 214, located at a side of the spring seat body 212 and detachably connected with the U-shaped groove 162; and a second mounting portion 216, located at a side of the spring seat body 212 away from the first mounting portion 214. In a second direction Y perpendicular to the first direction X from the first mounting portion 214 to the second mounting portion 216, the size of the second mounting portion 216 is smaller than the size of the spring seat body 212 to form a boss structure with the spring seat body 212, and the boss structure is configured to be detachably connected with the spring. Therefore, the boss structure can conveniently mount the spring.

In some examples, as illustrated in FIGS. 6 and 8, a surface of the spring mounting portion 160 away from the plunger passage 150 includes a mounting surface 164, a cut surface of the spring mounting portion 160 cut by the U-shaped groove 162 is an inclined surface 1620, the included angle between the inclined surface 1620 and the mounting surface 164 is less than 90 degrees, the spring seat body 212 is in contact with the mounting surface 164, and the first mounting portion 214 includes a cone-shaped structure 2140. The size of a part of the cone-shaped structure 2140 close to the spring seat body 212 is smaller in size than that of a part of the cone-shaped structure 2140 away from the spring seat body 212 to form a conical surface 2142, the conical surface 2142 is in contact with the inclined surface 1620 to mount the spring seat body 212 on the spring mounting portion 160.

In some examples, as illustrated in FIG. 8, the spring seat 210 includes a second fluid hole 218 passing through the first mounting portion 214, the spring seat body 212 and the second mounting portion 216. Therefore, the fluid can also enter the plunger passage 150 through the second fluid hole 218 and then flow out from the first fluid hole 120.

Figure 9:
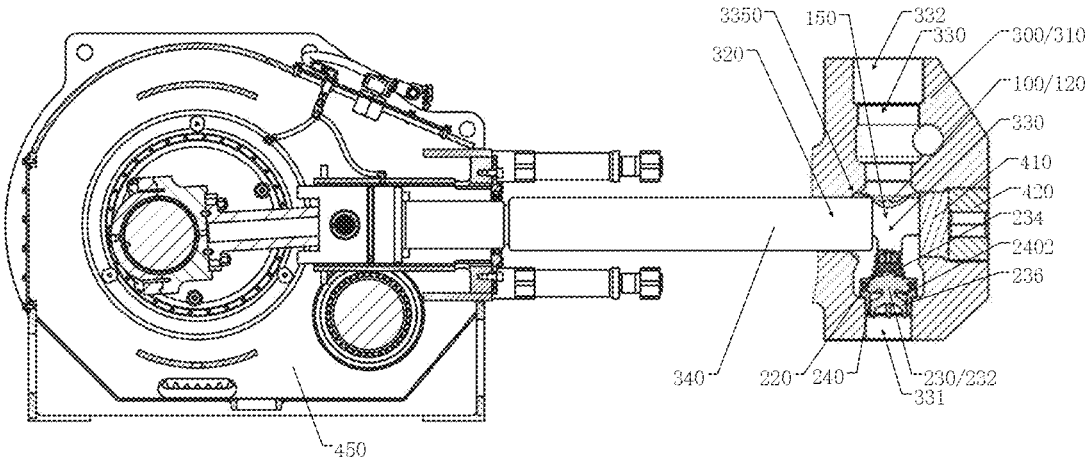
FIG. 9 is a schematic structural diagram of a plunger pump according to an embodiment of the present disclosure.

An embodiment of the present disclosure further provides a plunger pump. FIG. 9 is a schematic structural diagram of a plunger pump according to an embodiment of the present disclosure. As illustrated in FIG. 9, the plunger pump 400 includes a hydraulic end 300, the hydraulic end 300 includes a valve box 310, a plunger 340 and the valve assembly 200 provided by any of the above examples. The valve box 310 includes a plunger chamber 320 and a fluid chamber 330 located inside the valve box 310. The plunger 340 is located in the plunger chamber 320 and configured to reciprocate along the plunger chamber 320.

As illustrated in FIG. 9, the plunger chamber 320 and the fluid chamber 330 cross each other and form an alternating chamber 335 at the crossing position. The valve spring seat sleeve 100 is arranged at the alternating chamber 335. A first axis of the plunger passage 150 is parallel to a second axis of the plunger 340. The size of the plunger passage 150 in the direction perpendicular to the first axis is greater than or equal to the size of the plunger 340 in the direction perpendicular to the second axis, so as to allow the plunger 340 to pass through.

In the plunger pump provided by the embodiment of the present disclosure, because the valve spring seat sleeve does not need to be fixed by arranging a groove in the inner chamber of the valve box, stress concentration can be reduced, and the service life of the valve box can be prolonged, thereby prolonging the service life of the plunger pump and reducing the maintenance cost of the plunger pump. On the other hand, the valve spring seat sleeve will not rotate in the chamber inside the valve box, so it can provide a more stable fixing effect for the spring, thus improving the performance of the plunger pump.

For example, the case where the first axis of plunger passage 150 is parallel to the second axis of plunger 340 includes the case where the first axis of plunger passage 150 coincides with the second axis of plunger 340.

In some examples, as illustrated in FIG. 9, the fluid chamber 330 includes a third end portion 331 and a fourth end portion 332 which are oppositely arranged in the axial direction of the fluid chamber 330, and the spring 220 and the spring seat 210 are located at a side of the valve spring seat sleeve 100 close to the third end portion 310.

In some examples, as illustrated in FIG. 9, the plunger pump 400 further includes: a cover 410, located at a side of the valve spring seat sleeve 100; and a nut 420, located at a side of the cover 410 away from the valve spring seat sleeve 100. A part of the alternating chamber 335 away from the cover 410 includes a boss surface 3350, the first end portion 111 of the valve spring seat sleeve 100 is in contact with the boss surface 3350, and the cover 410 is in contact with the second end portion 112 of the valve spring seat sleeve 100 and configured to press the valve spring seat sleeve 100 under the pressure from the nut 420. Therefore, the plunger pump can press and fix the valve spring seat sleeve through the cover and nut.

In some examples, as illustrated in FIG. 9, the plunger pump further includes a power end 450. The power end 450 is connected with the plunger 340 and configured to drive the plunger 340 to reciprocate, thereby pressurizing the fluid in the valve box 310.

For example, the above-mentioned power end can adopt a crank-connecting rod mechanism to drive the plunger to reciprocate. Of course, the embodiments of the present disclosure include but are not limited thereto, and the power end can also adopt other ways to drive the plunger to reciprocate.

It should be noted that, in the above embodiments, the valve spring seat sleeve can be regarded as a valve spring fixing device, and the cylindrical hollow structure can also be regarded as a spring fixing piece. The valve spring seat sleeve can be fixed in a valve box by contacting a first supporting surface and a second supporting surface of the cylindrical hollow structure with the valve box.

Figure 10:
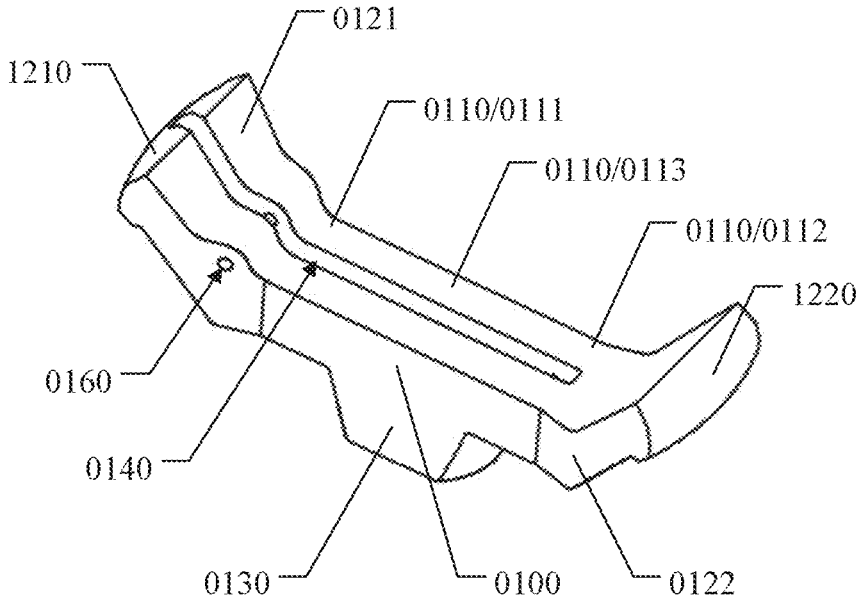
FIG. 10 is a schematic structural diagram of a valve spring fixing device according to an embodiment of the present disclosure.
Figure 11:
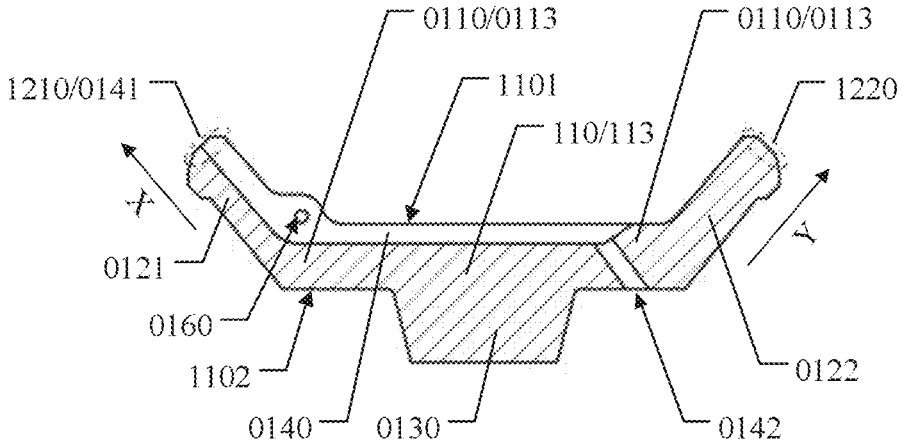
FIG. 11 is a schematic cross-sectional view of the valve spring fixing device in FIG. 10.

Embodiments of the present disclosure further provides a valve spring fixing device. FIG. 10 is a schematic structural diagram of a valve spring fixing device according to an embodiment of the present disclosure; FIG. 11 is a schematic cross-sectional view of the valve spring fixing device in FIG. 10.

As illustrated in FIG. 10 and FIG. 11, the valve spring fixing device includes a spring fixing piece 0100 and a spring mounting portion 0130. The spring fixing piece 0100 includes a first supporting surface 1210 and a second supporting surface 1220 located at two ends of the spring fixing piece 0100, and an intermediate portion 0113 located between the first supporting surface 1210 and the second supporting surface 1220. The spring mounting portion 0130 is connected with the intermediate portion 0113 and is configured to mount the valve spring, and the first supporting surface 1210 and the second supporting surface 1220 are both configured to contact with the valve box to fix the valve spring fixing device in the valve box. Therefore, the structure of the valve spring fixing device is simple, and the valve spring fixing device does not need to be connected with a sealing assembly, so that the throttling area of the valve spring fixing device is smaller, and the obstruction to the flow of fluid is smaller, so that the efficiency of the hydraulic end can be improved.

In some examples, as illustrated in FIG. 10 and FIG. 11, the spring fixing piece 0100 includes a body portion 0110, a first supporting portion 0121, a second supporting portion 0122, a spring mounting portion 0130 and a limiting groove 0140. The first supporting portion 0121, the body portion 0110 and the second supporting portion 0122 can form a C-shaped structure, thus facilitating the plunger to move above the body portion 0110.

As illustrated in FIG. 10 and FIG. 11, the body portion 0110 includes a first end portion 0111, a second end portion 0112 and an intermediate portion 0113 located between the first end portion 0111 and the second end portion 0112. The first supporting portion 0121 is connected with the first end portion 0111 and located at a first side of the body portion 0110; the second supporting portion 0122 is connected with the second end portion 0112 and located at the first side of the body portion 0110; that is to say, the first supporting portion 0121 and the second supporting portion 0122 are located at a same side of the body portion 0110.

As illustrated in FIG. 10 and FIG. 11, the spring mounting portion 0130 is connected with the intermediate portion 0113 and located at a second side of the body portion 0113, and the second side and the first side are two sides facing away from each other. That is to say, the spring mounting portion 0130 is located at a side of the body portion 0110 both away from the first supporting portion 0121 and the second supporting portion 0122. The limiting groove 0140 is configured to place a limiting assembly, which can be used to limit the rotation of the spring fixing piece 0100.

As illustrated in FIG. 10 and FIG. 11, the first supporting portion 0121 includes the first supporting surface 1210 located at an end of the first supporting portion 0121 away from the first end portion 0111. The second supporting portion 0122 includes the second supporting surface 1220 located at an end of the second supporting portion 0122 away from the second end portion 0112. The first supporting surface 1210 and the second supporting surface 1220 are both configured to contact with the valve box, thereby fixing the spring fixing piece 0100 inside the valve box. The limiting groove 0140 is located in at least one of the first supporting portion 0121 and the second supporting portion 0122 and is exposed to at least one of the first supporting surface 1210 and the second supporting surface 1220. It should be noted that the above-mentioned "exposed" means that the limiting groove passes through the first supporting surface or the second supporting surface without being blocked by the first supporting surface and the second supporting surface.

Figure 12:
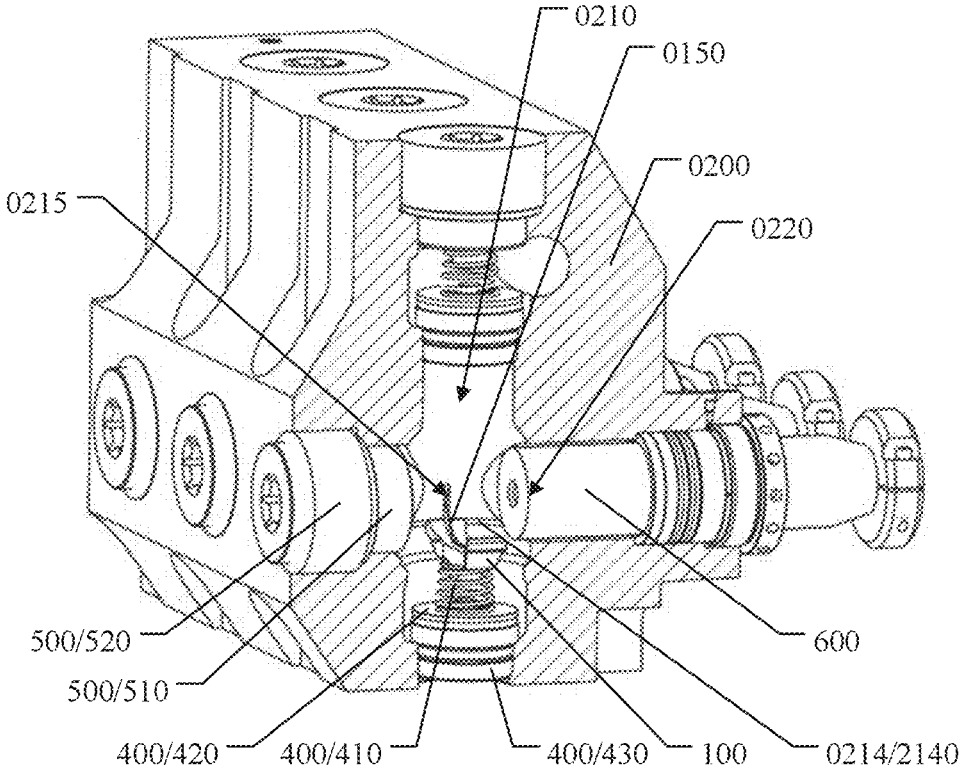
FIG. 12 is a schematic structural diagram of a hydraulic end of a plunger pump according to an embodiment of the present disclosure.
Figure 13A:
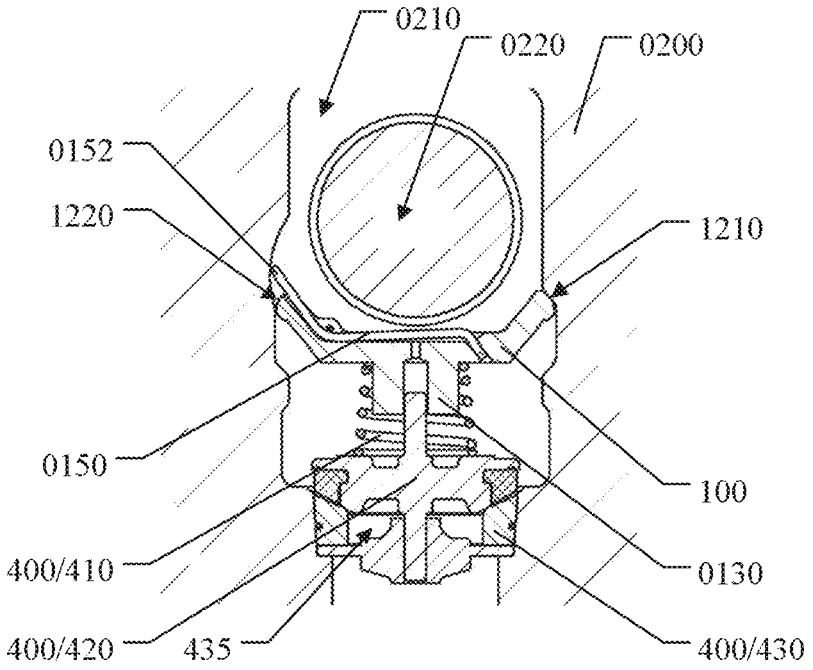
FIG. 13A is a schematic cross-sectional view of a hydraulic end of a plunger pump according to an embodiment of the present disclosure.
Figure 13B:
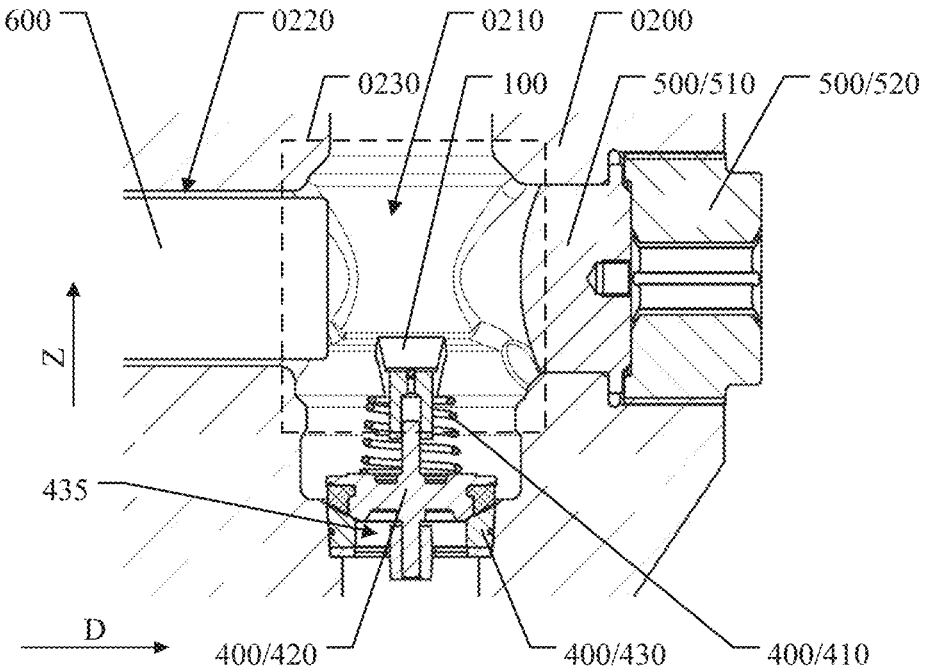
FIG. 13B is a schematic cross-sectional view of the hydraulic end of another plunger pump according to an embodiment of the present disclosure.

FIG. 12 is a schematic structural diagram of a hydraulic end of a plunger pump according to an embodiment of the present disclosure; FIG. 13A is a schematic cross-sectional view of a hydraulic end of a plunger pump according to an embodiment of the present disclosure; FIG. 13B is a schematic cross-sectional view of the hydraulic end of another plunger pump according to an embodiment of the present disclosure.

As illustrated in FIG. 12, FIG. 13A and FIG. 13B, the hydraulic end 0300 is provided with the above-mentioned valve spring fixing device 100. Through the contact of both the first supporting surface 1210 and the second supporting surface 1220 with the valve box 0200, the first supporting portion 0121 and the second supporting portion 0122 can fix the valve spring fixing device 100 in a chamber 0210 inside the valve box 0200, and the limiting groove 0140 can be used for placing a limiting assembly 0150 which can be exposed to the first supporting surface 1210 and/or the second supporting surface 1220 and be clamped in a valve box groove 0215 on the inner wall side of the chamber 0210, so that the rotation of the valve spring fixing device 100 can be limited.

On the one hand, because the valve spring fixing device does not need to contact or connect with the sealing assembly at an end of the chamber, the acting force generated by the fluid will not be transmitted to the sealing assembly, so that problems such as fatigue fracture of the threads of the sealing assembly can be avoided. On the other hand, because the structure of the valve spring fixing device is simple, and the limiting assembly can be clamped in the valve box groove by rotating the valve spring fixing device after installing the body portion, the first supporting portion and the second supporting portion of the valve spring fixing device in place, it has lower installation difficulty. It should be noted that the limiting assembly can have certain elasticity, so it is convenient to be clamped in the valve box groove in a narrow chamber. In addition, because the structure of valve spring fixing device is simple and does not need to be connected with a sealing assembly, the throttling area of the valve spring fixing device is smaller, and the obstruction to the flow of fluid is smaller, so that the efficiency of the hydraulic end can be improved.

In some examples, as illustrated in FIG. 12, FIG. 13A and FIG. 13B, the valve spring fixing device 100 further includes a limiting assembly 0150 located in the limiting groove 0140. The limiting assembly 0150 includes a limiting portion 0152 which protrudes from the first supporting surface 1210 and/or the second supporting surface 1220.

In some examples, as illustrated in FIG. 12, FIG. 13A and FIG. 13B, the limiting assembly 0150 includes a snap spring. The snap spring has certain elasticity, so it is convenient to install in a narrow chamber. Of course, the embodiments of the present disclosure include but are not limited thereto, and the limiting assembly can also include other structures.

In some examples, as illustrated in FIG. 10 and FIG. 11, the limiting groove 0140 is also located in the body portion 0110. Therefore, the limiting assembly 0150 has a larger contact area with the spring fixing piece 0100 and is therefore more stable.

In some examples, as illustrated in FIG. 10 and FIG. 11, the first supporting portion 0121 extends along a first direction X, and the second supporting portion 0122 extends along a second direction Y; it should be noted that the extension direction of the first supporting portion 0121 is from the first end portion 0111 to the first supporting surface 1210, and the extension direction of the second supporting portion 0122 can be from the second end portion 0112 to the second supporting surface 1220.

In some examples, as illustrated in FIG. 10 and FIG. 11, an included angle between the first direction X and a direction perpendicular to a first surface 1101 of the body portion 0110 at the first side ranges from 120 to 150 degrees, and an included angle between the second direction Y and a direction perpendicular to a first surface 1101 of the body portion 0110 at the first side ranges from 120 to 150 degrees. Therefore, the valve spring fixing device can give consideration to better mechanical properties and smaller throttling area.

In some examples, as illustrated in FIG. 10 and FIG. 11, the limiting groove 0140 includes a first end 0141 and a second end 0142, the first end 0141 is located at the first supporting surface 1210, the second end 0112 is located at the second end portion 0112, and the limiting groove 0140 extends from the first supporting surface 1210 to the second end 0112, so that the limiting assembly can be better fixed on the body portion 0110 and the first supporting portion 0122.

In some examples, as illustrated in FIG. 10 and FIG. 11, the limiting groove 0140 is exposed to the first surface 1101 at the first side of the body portion 0110 and the surface where the first supporting portion 0121 is connected with the first surface 1101. Therefore, the limiting assembly can be conveniently placed in the limiting groove.

In some examples, as illustrated in FIG. 10 and FIG. 11, the second end 0142 penetrates through the body portion 0110 and is exposed to the second surface 1102 of the body portion 0110 at the second side, so that the limiting assembly can be better confined in the limiting groove and prevented from jumping out.

In some examples, as illustrated in FIG. 10 and FIG. 11, the spring fixing piece 0100 further includes a pin hole 0160 and a limiting pin 0170; the pin hole 0160 is located in the first supporting portion 0121 and passes through the limiting groove 0140; the limiting pin 0170 is configured to be inserted into the pin hole 0160 to fix the limiting assembly 0150 in the limiting groove 0140.

Figure 14:
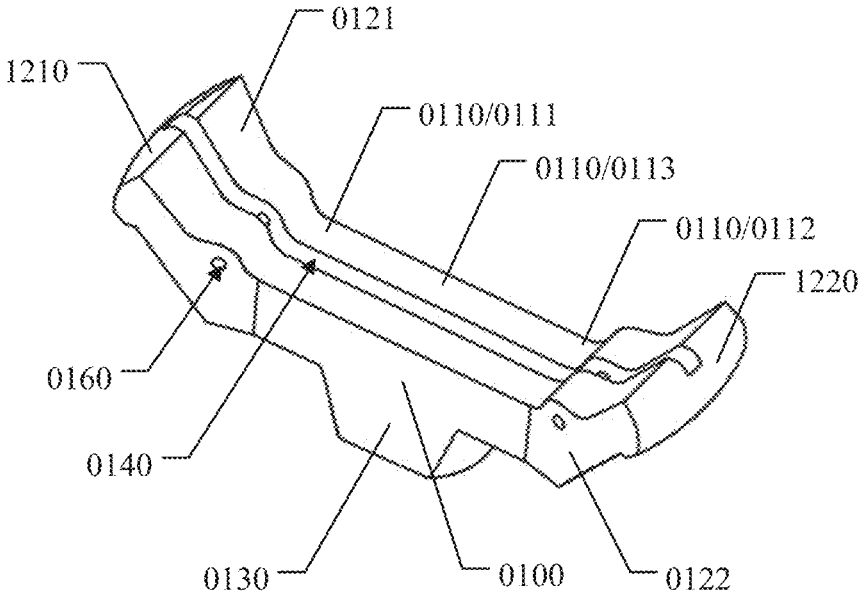
FIG. 14 is a schematic structural diagram of another valve spring fixing device according to an embodiment of the present disclosure.
Figure 15:
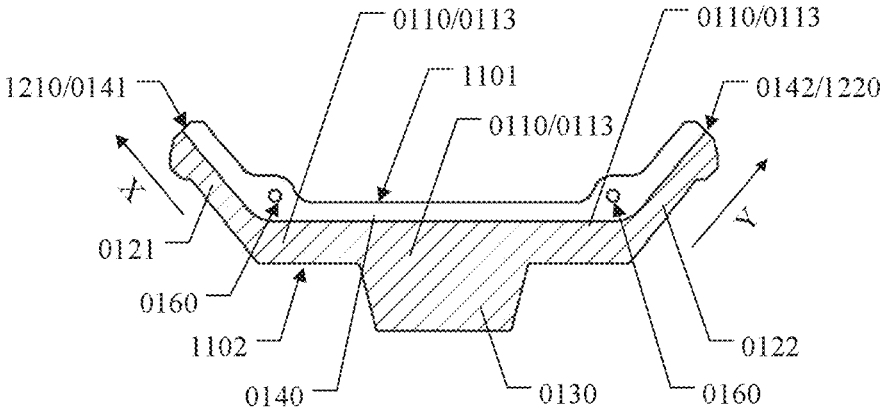
FIG. 15 is a schematic cross-sectional view of the valve spring fixing device in FIG. 14.

FIG. 14 is a schematic structural diagram of another valve spring fixing device according to an embodiment of the present disclosure; FIG. 15 is a schematic cross-sectional view of the valve spring fixing device in FIG. 14. As illustrated in FIG. 14 and FIG. 15, the spring fixing piece 0100 includes a body portion 0110, a first supporting portion 0121, a second supporting portion 0122, a spring mounting portion 0130 and a limiting groove 0140. The first supporting portion 0121, the body portion 0110 and the second supporting portion 0122 can form a structure similar to a C-shape, thus facilitating the plunger to move above the body portion 0110.

As illustrated in FIG. 14 and FIG. 15, the body portion 0110 includes a first end portion 0111, a second end portion 0112 and an intermediate portion 0113 located between the first end portion 0111 and the second end portion 0112. The first supporting portion 0121 is connected with the first end portion 0111 and located at a first side of the body portion 0110; the second supporting portion 0122 is connected with the second end portion 0112 and located at the first side of the body portion 0110; that is to say, the first supporting portion 0121 and the second supporting portion 0122 are both located at the same side of the body portion 0110.

As illustrated in FIG. 14 and FIG. 15, the spring mounting portion 0130 is connected with the intermediate portion 0113 and located at a second side of the body portion 0113, and the second side and the first side are two sides facing away from each other. That is to say, the spring mounting portion 0130 is located at a side of the body portion 0110 both away from the first supporting portion 0121 and the second supporting portion 0122. The limiting groove 0140 is configured to place a limiting assembly, which can be used to limit the rotation of the spring fixing piece 0100.

As illustrated in FIG. 14 and FIG. 15, the first supporting portion 0121 includes a first supporting surface 1210 located at an end of the first supporting portion 0121 away from the first end portion 0111. The second supporting portion 0122 includes a second supporting surface 1220 located at an end of the second supporting portion 0122 away from the second end portion 0112. The first supporting surface 1210 and the second supporting surface 1220 are configured to contact with the valve box, thereby fixing the spring fixing piece 0100 inside the valve box. The limiting groove 0140 includes a first end 0141 and a second end 0142, the first end 0141 is located at the first supporting surface 1210 and the second end 0142 is located at the second supporting surface 1220, and the limiting groove 0140 extends from the first supporting surface 1210 to the second supporting surface 1220. Therefore, the limiting groove 0140 has a larger length, and two ends of the limiting assembly 0150 are both clamped in the valve box groove, thus further increasing the stability of the valve spring fixing device.

In some examples, as illustrated in FIG. 14 and FIG. 15, the limiting groove 0140 is exposed to a first surface 1101 at the first side of the body portion 0110, the surface of the first supporting portion 0121 connected to the first surface 1101, and the surface of the second supporting portion 0122 connected to the first surface 1101. Therefore, the limiting assembly can be conveniently placed in the limiting groove.

In some examples, as illustrated in FIG. 14 and FIG. 15, the spring fixing piece 0100 further includes a pin hole 0160 and a limiting pin 0170; the pin hole 0160 is located in the first supporting portion 0121 and the second supporting portion 0122 and passes through the limiting groove 0140; the limiting pin 0170 is configured to be inserted into the pin hole 0160 to fix the limiting assembly 0150 in the limiting groove 0140. That is to say, both the first supporting portion 0121 and the second supporting portion 0122 are provided with pin holes 0160 and limiting pins 0170, so that two ends of the limiting assembly can be fixed in the limiting grooves 0140 in the first supporting portion 0121 and the second supporting portion 0122, respectively.

Figure 16:
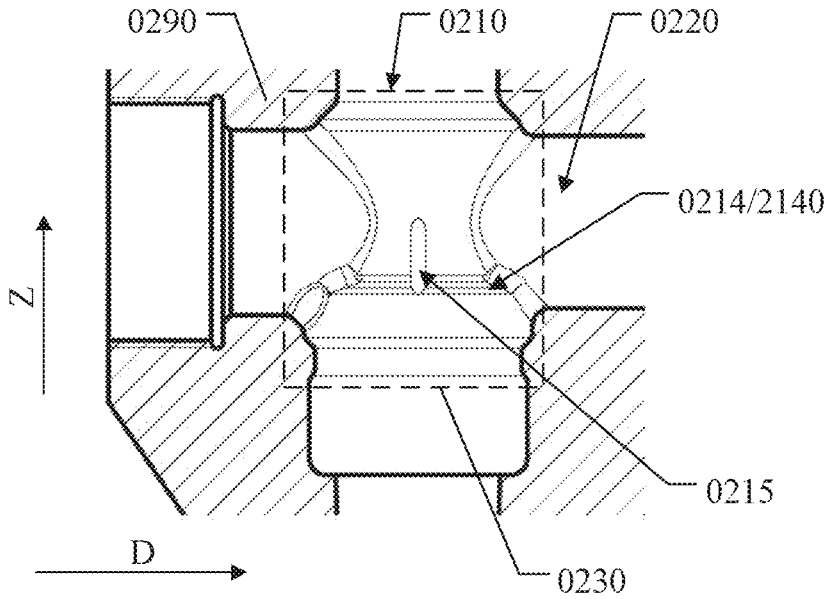
FIG. 16 is a schematic structural diagram of a valve box according to an embodiment of the present disclosure.

An embodiment of the present disclosure further provides a valve box. FIG. 16 is a schematic structural diagram of a valve box according to an embodiment of the present disclosure. As illustrated in FIG. 16, the valve box 0200 includes a valve box body 0290, a first chamber 0210 located in the valve box body 0290, a supporting groove 0214 and a valve box groove 0215. The first chamber 0210 extends in a third direction. The supporting groove 0214 is located in the inner sidewall of the first chamber 0210 and extends along the circumferential direction of the first chamber 0210. The supporting groove 0214 includes an inclined sidewall 2140 configured to contact with the first supporting surface and the second supporting surface, and the valve box groove intersects the inclined sidewall and extends in the third direction. It should be noted that the above-mentioned "circumferential direction" refers to the direction of one circle around the cross section of the first chamber.

In some examples, as illustrated in FIG. 16, the valve box 0200 further includes a second chamber 0220 located in the valve box body 0290 and extending in a fourth direction. The second chamber 0220 and the first chamber 0210 intersect to form an intersection area 0230 where the supporting groove 0214 and the valve box groove 0215 are located. For example, the third direction and the fourth direction may be perpendicular to each other.

An embodiment of the present disclosure further provides a plunger pump, which includes the valve spring fixing device and the valve box according to the above embodiments. FIG. 12 is a schematic structural diagram of a hydraulic end of a plunger pump according to an embodiment of the present disclosure; FIG. 13A is a schematic cross-sectional view of a hydraulic end in FIG. 12; FIG. 13B is a schematic cross-sectional view of another hydraulic end in FIG. 12. As illustrated in FIG. 12, FIG. 13A and FIG. 13B, the plunger pump 900 includes a hydraulic end 0300, the hydraulic end 0300 includes the above-mentioned valve spring fixing device 100 and valve box 0200. The first supporting surface 1210 and the second supporting surface 1220 of the valve spring fixing device 100 can contact with the supporting groove 0214 (e.g., the inclined sidewall 2140) to fix the valve spring fixing device 100 in the third direction; the limiting assembly 0150 can be partially located in the valve box groove 0215, so that it can be clamped in the valve box groove 0215 to limit the rotation of the valve spring fixing device 100.

In the plunger pump according to the embodiment of the present disclosure, because the valve spring fixing device can prevent the pressure of fluid being transmitted to the sealing assembly, and has the advantages of simple structure, easy installation, small throttling area, etc., the plunger pump has the advantages of higher use stability, longer service life, lower maintenance difficulty, higher efficiency, etc.

In some examples, as illustrated in FIG. 12, FIG. 13A and FIG. 13B, the hydraulic end 0300 further includes a valve assembly 400. The valve assembly 400 includes a valve spring 410, a valve body 420 and a valve seat sleeve 430; one end of the valve spring 410 is connected to the spring mounting portion 0130 of the spring fixing piece 0100, and the other end of the valve spring 410 is connected to the valve body 420. The valve seat sleeve 430 is fixed in the first chamber 0210 and includes an intermediate hole 435.

As illustrated in FIG. 12, FIG. 13A and FIG. 13B, the hydraulic end 0300 further includes a sealing assembly 500 and a plunger 600. The sealing assembly 500 is located at one end of the second chamber 0220, and the plunger 600 is at least partially located at the other end of the second chamber 200 and can reciprocate in the second chamber 0220. The sealing assembly 500 may include a cover 510 and a nut 520. The cover 510 can tightly connect an end of the second chamber 0220 through threads, and the nut 520 can tightly press the cover 510, thereby sealing the end of the second chamber 0220.

As illustrated in FIG. 12, FIG. 13A and FIG. 13B, in the case that the valve spring 410 is mounted on the valve spring fixing device 100, the inclined sidewall 2140 of the supporting groove 0214 of the valve box 0200 can apply a force to the valve spring 410 toward the valve seat sleeve 430 through the first supporting surface 1210 and the second supporting surface 1220; in this case, under the elastic force of the valve spring 410, the valve body 420 is located in the valve seat sleeve 430, and the intermediate hole 435 of the valve seat sleeve 430 is sealed. While the fluid flows in a direction from the valve body 420 to the valve spring fixing device 100, the fluid can apply pressure on the valve body 420 and make the valve spring 410 in a compressed state, in this situation the fluid can flow through the intermediate hole 435 of the valve seat sleeve 430; while the fluid flows in a direction from the valve spring fixing device 100 to the valve body 420, the valve body 420 is forced toward the valve seat sleeve 430, and in this situation the fluid cannot flow through the intermediate hole 435 of the valve seat sleeve 430. In this case, the low-pressure fluid can be sucked into the first chamber 0210 and the second chamber 0220 from the outside through the valve assembly when the plunger 600 makes a return movement (movement in a direction away from the cover); the low-pressure fluid in the first chamber 0210 and the second chamber 0220 is pressurized when the plunger 600 moves in the process (moving in a direction close to the cover).

In some examples, as illustrated in FIG. 12, FIG. 13A and FIG. 13B, the first supporting portion 0121 and the second supporting portion 0122 can fix the valve spring fixing device 100 in the first chamber 0210 inside the valve box 0200 through the contact of the first supporting surface 1210 and the second supporting surface 1220 with the inclined sidewall 2140 of the supporting groove 0214 of the valve box 0200. The limiting groove 0140 can be used to place the limiting assembly 0150, which can be exposed to the first supporting surface 1210 and/or the second supporting surface 1220 and clamped in the valve box groove 0215 on the inner wall side of the chamber 0210, thus limiting the rotation of the valve spring fixing device 100.

On the one hand, because the valve spring fixing device 100 does not need to contact or connect with the cover 510 at an end of the second chamber 0220, the force generated by the fluid will not be transmitted to the cover 510, so that problems such as fatigue fracture of the screw thread of the cover 510 can be avoided. Therefore, the plunger pump has longer service life and lower maintenance cost.

On the other hand, because the structure of the valve spring fixing device 100 is simple, and the limiting assembly 0150 can be clamped in the valve box groove 0215 by rotating the valve spring fixing device 100 after installing the body portion 0110, the first supporting portion 0121 and the second supporting portion 0122 of the valve spring fixing device 100 in place, the installation difficulty is lower. Therefore, the plunger pump further has lower difficulty in installation and maintenance.

In addition, because the valve spring fixing device 100 has a simple structure and does not need to be connected with the cover 510, the throttling area of the valve spring fixing device 100 is smaller, and the obstruction to fluid flow is smaller, so that the efficiency of the plunger pump can be improved.

In some examples, the plunger pump can be used in fracturing equipment and fracturing operations in oil and gas fields. In addition, the power end of the plunger pump can include a crankshaft connecting rod mechanism, so that the rotary motion input by the prime Mover can be converted into the reciprocating motion of the plunger, and the prime Mover can be a diesel engine, an electric motor, a turbine engine, etc., and embodiments of the present disclosure will not be described in detail here.

The following statements need to be explained:

(1) In the drawings of the embodiments of the present disclosure, only the structures related to the embodiments of the present disclosure are involved, and other structures may refer to the common design(s):

(2) In case of no conflict, features in one embodiment or in different embodiments of the present disclosure can be combined.

The above are merely particular embodiments of the present disclosure but are not limitative to the scope of the present disclosure; any of those skilled familiar with the related arts can easily conceive variations and substitutions in the technical scopes disclosed in the present disclosure, which should be encompassed in protection scopes of the present disclosure. Therefore, the scopes of the present disclosure should be defined in the appended claims.

The invention claimed is:

1. A valve spring fixing device, comprising:

a spring fixing piece, comprising a first supporting surface and a second supporting surface located at two ends of the spring fixing piece, and an intermediate portion located between the first supporting surface and the second supporting surface; and a spring mounting portion connected with the intermediate portion and configured to mount a valve spring, wherein the first supporting surface and the second supporting surface are configured to contact with a valve box to fix the valve spring fixing device, the spring fixing piece comprises:

a body portion, comprising a first end portion, a second end portion, and the intermediate portion located between the first end portion and the second end portion;

a first supporting portion connected with the first end portion and located at a first side of the body portion;

a second supporting portion connected with the second end portion and located at the first side of the body portion; and a limiting groove, which is configured to place a limiting assembly; wherein the limiting groove is located in at least one of the first supporting portion and the second supporting portion, and is exposed to at least one of the first supporting surface and the second supporting surface.

2. The valve spring fixing device according to claim 1, wherein the spring mounting portion is located at a second side of the body portion, and the second side and the first side are two sides facing away from each other; the first supporting portion comprises the first supporting surface located at an end of the first supporting portion away from the first end portion, the second supporting portion comprises the second supporting surface located at an end of the second supporting portion away from the second end.

3. The valve spring fixing device according to claim 2, wherein the limiting groove is further located in the body portion.

4. The valve spring fixing device according to claim 2, wherein the first supporting portion extends in a first direction and the second supporting portion extends in a second direction;

an comprised angle between the first direction and a direction perpendicular to a first surface of the body portion at the first side ranges from 120 to 150 degrees, and an comprised angle between the second direction and the direction perpendicular to the first surface of the body portion at the first side ranges from 120 to 150 degrees.

5. The valve spring fixing device according to claim 2, wherein the limiting groove comprises a first end and a second end, the first end is located at the first supporting surface, the second end is located at the second end portion, and the limiting groove extends from the first supporting surface to the second end portion.

6. The valve spring fixing device according to claim 5, wherein the limiting groove is exposed to the first surface of the body portion at the first side and a surface of the first supporting portion connected with the first surface.

7. The valve spring fixing device according to claim 6, wherein the second end penetrates through the body portion and is exposed to a second surface of the body portion at the second side.

8. The valve spring fixing device according to claim 2, wherein the limiting groove comprises a first end and a second end, the first end is located at the first supporting surface, the second end is located at the second supporting surface, and the limiting groove extends from the first supporting surface to the second supporting surface.

9. The valve spring fixing device according to claim 8, wherein the limiting groove is exposed to a first surface of the body portion at the first side, a surface of the first supporting portion connected to the first surface and a surface of the second supporting portion connected to the first surface.

10. The valve spring fixing device according to claim 2, further comprising:

a limiting assembly, located in the limiting groove, wherein the limiting assembly comprises a limiting portion, and the limiting portion protrudes from the first supporting surface and/or the second supporting surface.

11. The valve spring fixing device according to claim 10, wherein the limiting assembly comprises a snap spring.

12. The valve spring fixing device according to claim 2, further comprises:

a pin hole located in the first supporting portion and/or the second supporting portion and passing through the limiting groove; and a limiting pin configured to be inserted into the pin hole to fix the limiting assembly in the limiting groove.

13. A plunger pump, comprising:

a valve box, comprising a valve box body, a first chamber, a supporting groove and a valve box groove, wherein the first chamber is located in the valve box body and extends along a third direction; the supporting groove is located in an inner sidewall of the first chamber and extends along a circumferential direction of the first chamber; the supporting groove comprises an inclined sidewall, and the valve box groove intersects with the inclined sidewall and extends along the third direction; and a valve spring fixing device, comprising a spring fixing piece and a spring mounting portion, wherein the spring fixing piece comprises a first supporting surface and a second supporting surface located at two ends of the spring fixing piece and an intermediate portion located between the first supporting surface and the second supporting surface; the spring mounting portion is connected with the intermediate portion and configured to mount a valve spring, wherein the first supporting surface and the second supporting surface are contacted with the supporting groove to fix the valve spring fixing device in the valve box.

14. The plunger pump according to claim 13, wherein the spring fixing piece comprises:

a body portion, comprising a first end portion, a second end portion, and the intermediate portion located between the first end portion and the second end portion;

a first supporting portion, connected with the first end portion and located at a first side of the body portion; and a second supporting portion, connected with the second end portion and located at the first side of the body portion;

wherein the spring mounting portion is located at a second side of the body portion, and the second side and the first side are two sides facing away from each other; the first supporting portion comprises the first supporting surface located at an end of the first supporting portion away from the first end portion; the second supporting portion comprises the second supporting surface located at an end of the second supporting portion away from the second end portion;

the spring fixing piece further comprises a limiting groove, which is configured to place a limiting assembly; the limiting groove is located in at least one of the first supporting portion and the second supporting portion and exposed to at least one of the first supporting surface and the second supporting surface.

15. The plunger pump according to claim 14, wherein the limiting groove is further located at the body portion.

16. The plunger pump according to claim 14, wherein the first supporting portion extends in a first direction, and the second supporting portion extends in a second direction;

an comprised angle between the first direction and a direction perpendicular to a first surface of the body portion at the first side ranges from 120 to 150 degrees, and an comprised angle between the second direction and a direction perpendicular to the first surface of the body portion at the first side ranges from 120 to 150 degrees.

17. The plunger pump according to claim 14, wherein the limiting groove comprises a first end and a second end, the first end is located at the first supporting surface, the second end is located at the second end portion, and the limiting groove extends from the first supporting surface to the second end portion.

18. The plunger pump according to claim 13, wherein the valve box further comprises:

a second chamber, located in the valve box body and extending along a fourth direction, wherein the second chamber and the first chamber intersect to form an intersection area, and the supporting groove and the valve box groove are located in the intersection area.

19. The plunger pump according to claim 18, further comprising:

a plunger, located in the second chamber and configured to reciprocate along the second chamber;

a cover, located at an side of the valve spring fixing device; and a nut, located at an side of the cover away from the valve spring fixing device.

20. The plunger pump according to claim 19, further comprising:

a power end, connected with the plunger and configured to drive the plunger to reciprocate.

* * * * *